United States Patent [19]

Benedetti

[11] Patent Number: 4,751,956

[45] Date of Patent: Jun. 21, 1988

[54] DEVICE TO HANDLE LADLES

[75] Inventor: Giampietro Benedetti, Villaggio Primavera, Italy

[73] Assignee: Danieli & C. Officine Meccaniche SpA, Buttrio, Italy

[21] Appl. No.: 911,814

[22] Filed: Sep. 26, 1986

[30] Foreign Application Priority Data

Oct. 4, 1985 [IT] Italy ..... 83418 A/85
Aug. 27, 1986 [IT] Italy ..... 83397 A/86

[51] Int. Cl.[4] ..... B22D 41/00; B22D 11/10

[52] U.S. Cl. ..... 164/437; 164/335; 222/591; 222/604; 266/143; 266/276

[58] Field of Search ..... 164/437, 335, 336; 222/591, 604; 266/276, 143

[56] References Cited

U.S. PATENT DOCUMENTS

| | | | |
|---|---|---|---|
| 55,442 | 6/1866 | Lohage | 266/276 |
| 3,693,960 | 9/1972 | Golde et al. | 266/276 |
| 4,199,084 | 4/1980 | Margraf et al. | 222/591 |
| 4,286,738 | 9/1981 | Blum | 222/591 |
| 4,371,100 | 2/1983 | Mühlbauer et al. | 222/591 |
| 4,550,058 | 9/1985 | Kremer et al. | 266/276 |

FOREIGN PATENT DOCUMENTS

| | | | |
|---|---|---|---|
| 49890 | 4/1982 | European Pat. Off. | 222/591 |
| 285388 | 6/1914 | Fed. Rep. of Germany | 222/604 |
| 2044768 | 9/1970 | Fed. Rep. of Germany | 164/335 |
| 2028078 | 12/1971 | Fed. Rep. of Germany | 222/591 |
| 1371056 | 7/1964 | France | 222/591 |
| 1551721 | 11/1968 | France | 222/591 |
| 1578603 | 7/1969 | France | 222/591 |
| 2437258 | 9/1978 | France | 222/591 |
| 677023 | 2/1950 | United Kingdom | 222/591 |

OTHER PUBLICATIONS

M. Fischer, "Torre porta siviere per impianto di colata continua", La Rivista dei Cuscinett, No. 215, Sep. 1983.

*Primary Examiner*—Nicholas P. Godici
*Assistant Examiner*—Samuel M. Heinrich
*Attorney, Agent, or Firm*—Wegner & Bretschneider

[57] ABSTRACT

Device to handle ladles in cooperation with the casting zone (45) in continuous casting, casting into ingot moulds or forms or mixed casting, such device providing independent, coaxial arms able to rotate by a continuous 360° rotation and to support the ladle (14), such rotary arms (27) also handling the ladle (14) in a tapping station (43) in cooperation with a smelting furnace (11).

35 Claims, 7 Drawing Sheets

DEVICE TO HANDLE LADLES

BACKGROUND OF THE INVENTION

This invention concerns a device to handle ladles serving the casting zone. To be more exact, this invention concerns a device suitable to move ladles independently from a tapping position at a furnace, whether the furnace be an electric furnace or of another type, to a casting position after passing through intermediate stations for refining the steel or molten material in general and for cleaning the ladles themselves.

The device may be applied to zones for continuous casting, zones for casting into ingot moulds or zones for mixed casting with or without zones for emergency casting.

Ladles are positioned at present below a smelting furnace and then are filled and moved to the casting zone. For such movement a bridge crane is used, or else the ladle is run on appropriate rails and, if necessary, undergoes a series of auxiliary operations before reaching the casting zone or, viceversa, before returning to the furnace.

This situation entails a set of drawbacks in that the times of the operations are not coordinated and are relatively long, the various steps are not standardized and there is not an optimum process control.

The results obtainable are therefore far from being those which can theoretically be attained since all the above factors entail a series of drawbacks, above all as regards the lack of standardization of the various steps, increased downtimes and the lack of a continuous, automatic control of the process itself.

GB No. 677,023 is known and provides for a system to handle a ladle along a substantially circular path served by a bridge crane or hoist. Along this circular path the ladle undergoes a plurality of treatements, but GB No. 677,023 does not make exactly clear how the ladle is handled (rotation, tilting, overturning, etc.).

Beside its requirement for independent means (a lifting crane or hoist of a considerable size) the system disclosed in GB No. 677,023 imposes a plurality of restrictions, of which the main ones are as follows: the considerable difficulty of its use in cooperation with continuous casting precisely because of the need to lift the ladle; handling not tied to precise technical timings and therefore not optimum in relation to requirements of the manufacturing cycle; the need to have many ladles available at one and the same time so as to maintain the processing times imposed by the system; the employment of closure means (position 9) which are not suitable for modern casting systems; a very great and therefore uneconomical area is taken up; the systems for handling (tilting, overturning, etc.) the ladle itself are not disclosed in GB No. 677,023.

A system according to GB No. 677,023 can therefore not be installed in view of present requirements regarding time, quality and space relative to modern casting plants, but above all to problems of automation which have had to be considered for several years now.

In the final analysis, GB No. 677,023 is just a description of normal steps performed in a traditional steel mill; the one single new feature is that these steps are carried out along a circular plan.

FR No. 1.551.721 is also known but tackles only the problem of continuous casting in a continuous casting plant, that is to say, it tends to overcome the limitation of continuity of casting proper to a ladle because of its defined content. It provides for ladles, charged with molten metal in another part of a steel mill, to be brought to the device and put thereupon in replacement of empty ladles.

The device disclosed in FR No. 1.551.721 in fact replaces the normal casting carriages, in comparison with which it is still not possible to understand whether the device provides advantages or not; in fact, both systems are still employed.

The device of FR No. 1.551.721 can be applied only to continuous casting plants, and, if necessary, this can be understood from the description of the patent itself.

Owing to its specific destination and to the idea of the solution which it has generated, the device of FR 1.551.721 does not provide, for example, for rotation of the ladle on its own axis, nor for auxiliary operations at the molten bath, nor does it disclose how operations to restore the ladle can take place since, among other things, such operations are not even provided for.

Thus, besides having different purposes from those of GB No. 677,023, FR No. 1.551.721 does not discloses anything which can be integrated readily and obviously with the disclosures of GB No. 677,023.

In fact, the operational thinking of GB No. 677,023 can in no way be transferred to or integrated with the operational thinking of FR No. 1.551.721 as regards the different operating means or as regards the different intermediate operating purposes or different functional requirements which either of these patents tend to solve.

FR No. 1.578.603 and FR No. 1.371.056 conform substantially to FR No. 1.551.721.

FR No. 2.437.258 is substantially the same as FR No. 1.551.721 but, as compared to the latter, provides for full ladles to be taken independently and empty ladles to be discharged independently.

DE OS No. 2.028.078 is also known and discloses one single arm (in contrast to FR No. 1.551.721 which discloses two independent arms) extending symmetrically in relation to the axis of rotation and also envisages that the ladle can be overturned by a certain angle.

The Italian trade journal "La rivista dei Cuscinetti" (Journal of Bearings), no.215, shows on pages 1 to 3 an embodiment with stationary positioned arms which are yet capable of moving the ladle vertically. In this embodiment too, as in all those described above an in all existing embodiments which have not been cited here as they repeat the same concept, the ladle is loaded onto the device only after it has been charged with molten metal elsewhere and after it has been brought from the tapping zone to the zone in which the device operates.

It should be noted that hitherto no evolutive steps have been taken beyond FR No. 1.551.721, beyond GB No. 677,023, or beyond the other patents detailed herein, indicating the unchanging nature of the vision and reasoning of persons skilled in this field. This is so, notwithstanding the fact that the problems which the present invention tends to overcome have taken on considerable importance for many years now.

SUMMARY OF THE INVENTION

So as to obviate the problems and limitations inherent in the embodiments described above and to produce a plurality of advantages which will become clearer during this description, the present applicant has studied, tested and embodied the present invention.

This invention tends to cover all the steps required of a ladle from the time of the tapping of a furnace to the successive casting operation and also tends to eliminate unnecessary handling, to reduce and regulate the handling times, to standardize the steps of the process and to enable the process to be controlled in an automatic and optimum manner.

Moreover, the invention provides for action to be taken only at established positions and at stations for handling and corrective action which are properly equipped in a specialized manner, in times and conditions which are the best for carrying out pre-established operations of use for the smelting bath and for restoring the condition of the ladle.

The invention enables also the trolleys carrying the ladles and the cranes or bridge cranes of the steel mill which carry the ladles filled with molten steel to be eliminated. Such trolleys, cranes or bridge cranes have to bear the weight of a ladle filled with molten metal and therefore of necessity have to possess large dimensions.

Thus the invention frees the production shed of the bulk and danger involved in the employment of such means to handle ladles full of molten metal, and such handling means are retained only to handle empty ladles.

The invention provides for the employment of a closed and obligatory circuit carried out by a support means formed of one single body; such support means is specially equipped to be able to carry out all the direct and indirect requirements of the processing cycle.

Along this closed and obligatory circuit, which connects the tapping zone to the casting zone directly and independently, auxiliary stations are provided for refining the bath, cleaning the ladles and also for emergency casting.

The ladles are handled by at least two coaxial handling supports, which are coordinated with each other and each of which engages a ladle.

In a preferred embodiment of the invention two ladles are borne by a device with rotary arms, which constitute the handling supports; the device is located in an intermediate position between the smelting furnace and the casting station.

In this description the words "smelting furnace" are intended to cover the widest possible range, including smelting furnaces, refining furnaces, etc. and therefore any means able to supply molten metal to a ladle.

According to the invention the ladles may be alternatively in different positions; for instance, one ladle may be in the charging position whereas the other may be in the casting position, or both of them may be in determined intermediate positions in which they undergo auxiliary operations.

The aforesaid device with coaxial, independent, rotary arms is suitable to move the ladles from an initial position for charging the molten material to a successive position for refining and/or degassing the molten material, these being processes which also comprise the modification of the chemical composition of the molten material so as to obtain the required alloy, and then also to a successive position for casting either into a continuous casting plant or into ingot moulds or forms or into a plurality of usage means.

The ladle is positioned thereafter at an appropriate station for cleaning, readying and possibly carrying out minor maintenance work on the ladle, or for replacement of the ladle, while the other ladle is performing the aforesaid charging, refining and casting operations.

The various steps (charging from a furnace, refining and checking the composition, casting and cleaning the ladle) require, as is known, different lengths of time for their performance.

The movement of the arms, which usually takes place in a prefixed direction, is independent, so that when one specific step has been completed, a ladle can be taken at once to the next station for a specific subsequent step without interfering with the operation being carried out on the other ladle, such latter operation being wholly unlike that of the first ladle since the device works in the manner of a turntable.

The arms, therefore, normally move in the same direction at their own independent times but are out of phase with each other and independent as there are control and linking means which prevent the arms from occupying positions of mutual interference.

In a variation it is possible to provide for the arms to be able to move in either direction between two or more stations, for instance between the casting station and the refining station; the purpose of this is to enable the ladle to be brought back momentarily from the casting station to the refining station for corrections to an alloy at the last moment.

According to this variation such possible movement in the reverse direction is arranged between two or more stations so as to cover any eventuality.

In its preferred embodiment the invention provides for the employment of two arms.

In a variation the device may be equipped with yet more arms, which will be as many as the number of ladles to be employed at one and the same time.

The invention, therefore, not only provides for the inclusion of specific auxiliary stations, of which one is for refining, possible degassing and completion of the composition of an alloy and another is for cleaning, readying and possible replacement of a ladle, but also enables the cycle to be continuously controlled, downtimes to be avoided and all the operations to be optimized, so that the final result obtained will be a suitable action programmed within the periods of time allowed and with the required features.

The device is controlled by means which can be programmed to carry out the various steps according to a preset program, possibly arranged to suit the characteristics of the plant, the type of casting to be performed and the specific usage means into which the casting is to take place.

This device is especially suitable in the event of frequent castings, where it is very important that the times should be concentrated, the spaces should be reduced and the quality of the casting should be continuously controlled, with an ability to take continuous and preset corrective action.

The invention is therefore embodied in a device to handle ladles in cooperation with the casting zone in continuous casting, casting into ingot moulds or forms or mixed casting, such device providing independent, coaxial arms able to rotate by a continuous 360° rotation and to support the ladle, the device being characterized in that such rotary arms handle the ladle also in a tapping station in cooperation with a smelting furnace.

BRIEF DESCRIPTION OF THE DRAWINGS

The attached figures, which are provided as a nonrestrictive example, show the following.

DETAILED DESCRIPTION

As the positions are duplicated, one reference number is used in the figures for each position, while the duplicate positions bear the same reference number increased by one hundred.

In the figures, a device 10 is embodied with two coaxial rotary arms 27, of which one is supported above the other; these arms 27 cooperate with a stationary base 25 and a stationary bearing structure 58.

The rotary arms 27 can rotate through a continuous rotation of 360° or more and comprise safety and clamping means (not shown here) to obviate even transient positions of reciprocal contact.

Figure 4:
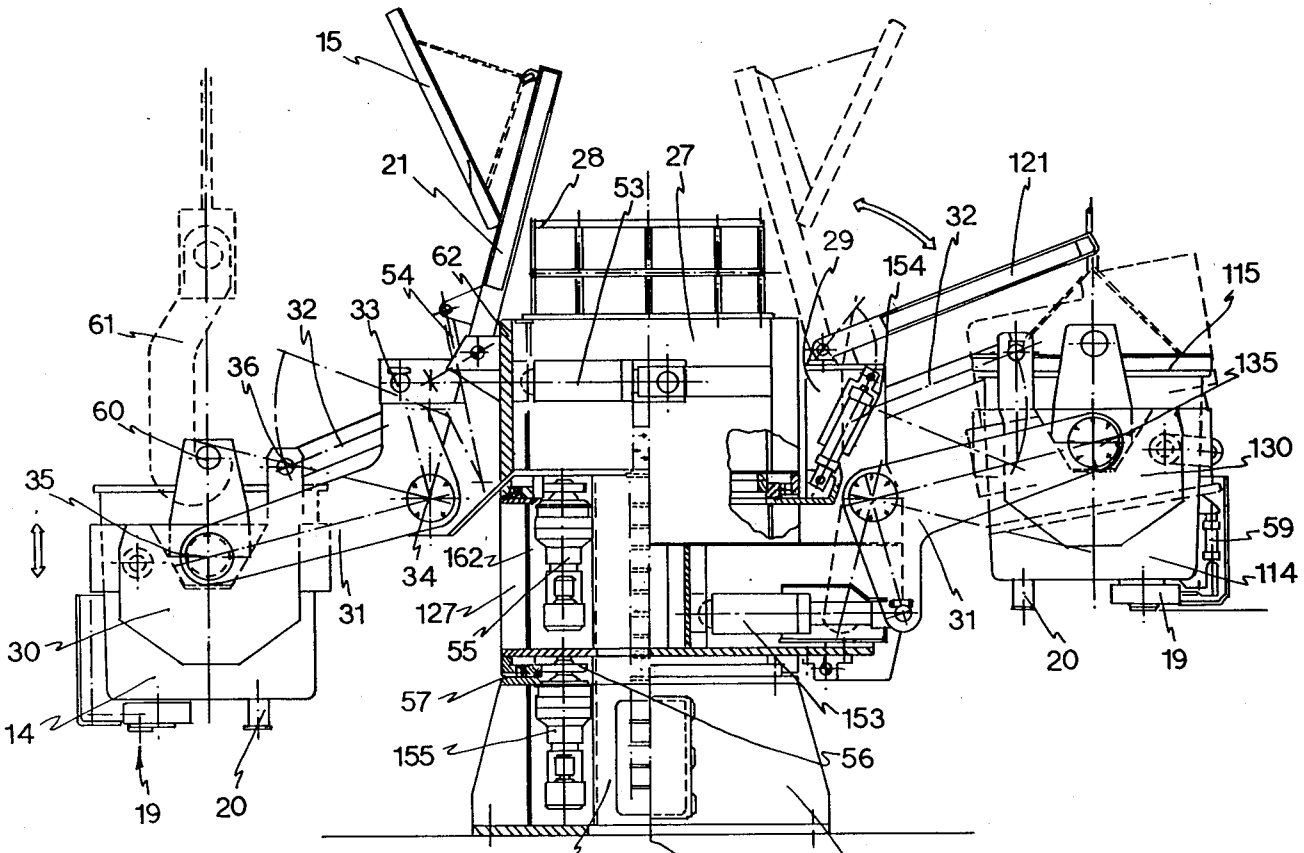
FIG. 4 gives a side view of preferred sections of the device of FIG. 1.

Above the arms 27 is a stand 28, to which in this case it is possible to accede from the interior (FIG. 4).

The arms 27 comprise a carrying structure 62 which can be rotated, by cooperation of a gear wheel 56 with a toothed wheel 57, about a vertical axis of rotation 26. The toothed wheel 57 is solidly attached to its respective carrying structure 62.

The gear wheel 56 is solidly attached to and actuated by a motor reducer unit 55, which is secured to the bearing structure 58.

Rotation of the arms 27 takes place normally in one direction alone but can be reversed between one station and another, or between several stations, when emergency or corrective action is requied.

To the carrying structures 62 are fitted vertically oscillatable work arms 31, which can oscillate on rotation pivots 34 under the action of jacks 53 acting on connection pivots 33. The rotation pivots 34 lie substantially on the same horizontal plane as each other. The result of this is that the arm 127 comprises a stationary arm 29 for the correct positioning of the other component elements.

The work arm 31 is anchored to a support pivot 35 for the support of a ladle 14. The support pivot 35 cooperates with a ladle-rotation means 30, which enables the ladle 14 to be rotated by 270° or more.

The ladle-rotation means 30 anchors the ladle 14 and can position it as required in positions ranging from that with a vertical axis to another position at a required angle.

A parallelogram linkage including arm 32 together with a connecting body 169 of the ladle-rotation means 30 acts on a control pivot 36 and enables the ladle 14 and ladle-rotation means 30 to be always kept properly positioned.

Figure 6:
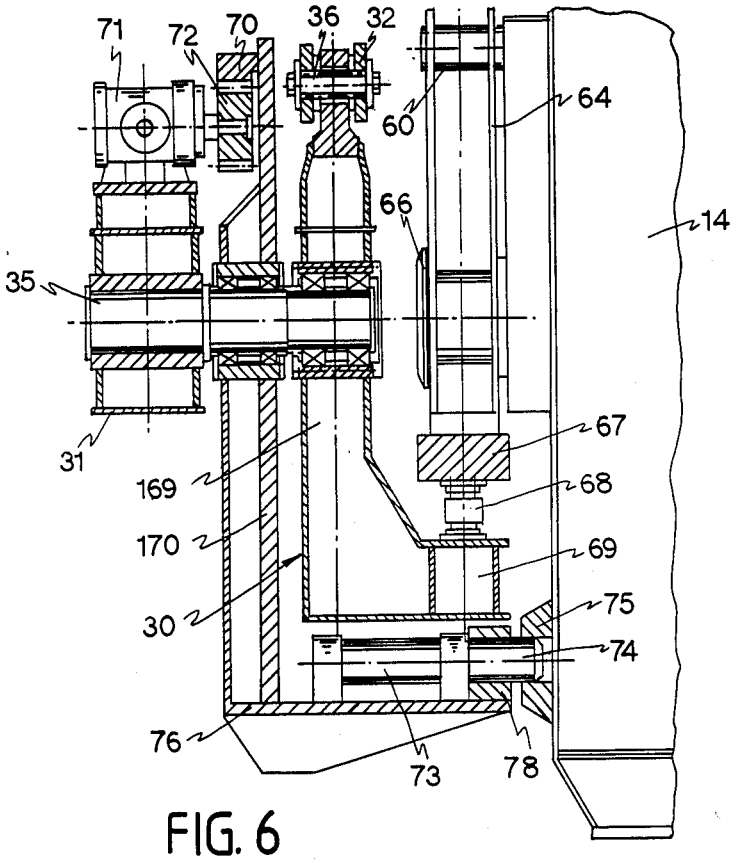
FIG. 6 shows a vertical section of the ladle support zone.

The ladle-rotation means 30 (FIG. 6) comprises a cradle 69, which supports and positions the ladle 14, being itself fitted so as to be able to oscillate on the support pivot 35.

An internally toothed ring 70 is also fitted to the support pivot 35 so as to be able to oscillate. Such toothed ring 70 covers an angle of less than 360° and is upheld by a carrying body 170 which comprises a support 76 at its end.

The support 76 comprises a guide 78 cooperating with a clamping bolt 74 able to slot momentarily into a socket on the ladle 14. The bolt 74 may be actuated, for instance, by a jack 73.

A toothed wheel 72 actuated by a motor reduction unit 71 solidly fixed to the work arm 31 cooperates with the internally toothed ring 70.

Where actuation is performed automatically, the positions of the toothed ring 70 and therefore of the ladle 14 can be monitored by a position monitor, for instance of an encoder type, fitted coaxially to the motor which drives the motor reduction unit 71, for example.

The ladle can be removed with the system proposed and with suitale lifting equipment by means of a lifting pivot 65, braces 64 and the pivot 66 of the ladle 14 itself.

In a variant the braces 64 are supported on a saddle 67, which rests on the cradle 69 through load cells 68 included to weigh the molten metal tapped into the ladle 14.

Guides 65 (FIG. 9) may be provided between the cradle 69 and saddle 67 for reciprocal positioning.

The axes of the support pivot 35 and of the pivot 66 of the ladle in fact coincide.

If it is desired to rotate the ladle 14, it is enough to clamp the work arm 31 and parallelogram arm 32, slide the bolt 74 into its socket 75 and actuate the motor reduction unit 71. By acting on the toothed wheel 72, the motor reduction unit 71 sets the toothed ring 70 in rotation and therewith the carrying body 170 and the ladle 14 itself.

A cover 15 cooperates with the ladle 14 and is supported by a lifting arm 21, which oscillates on a pivot 22 and is actuated by a jack 54.

The ladle comprises known supporting feet 20, a valve-type closure 19 for the casting of molten material and a jack 59 to actuate the valve 19.

As we said earlier, the ladle 14 comprises a lifting pivot 60 that cooperates with the braces 64 and with the pivot 66 of the ladle to remove or replace the ladle by means of the hook 61 of a crane.

With the device 10 according to the invention, therefore, the ladle 14 can be made to rotate around the vertical axis 26, or around the horizontal axis of the support pivot 35, such latter axis coinciding with the axis of the pivot 66 of the ladle.

An empty ladle can also be removed or replaced by a crane or hoist at any of the stations.

Figure 7:
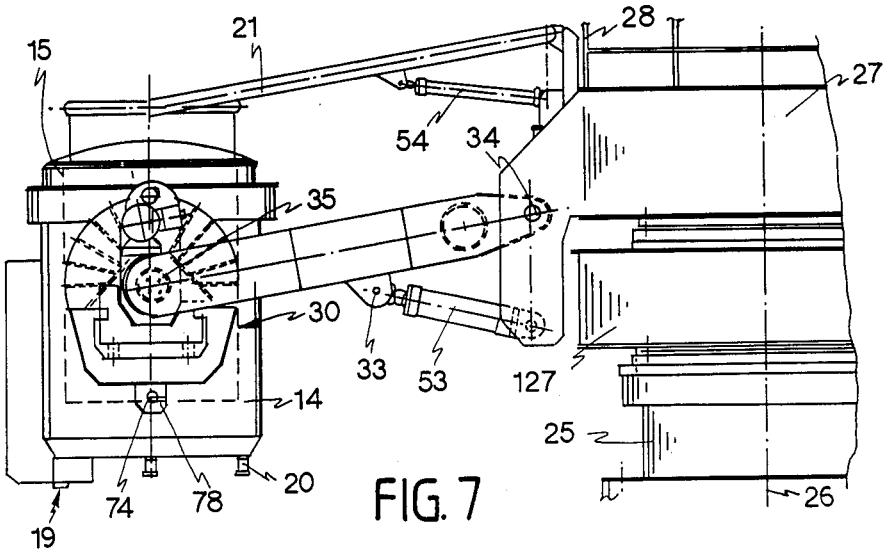
FIG. 7 shows a variant with one working arm that bears the ladle.
Figure 8:
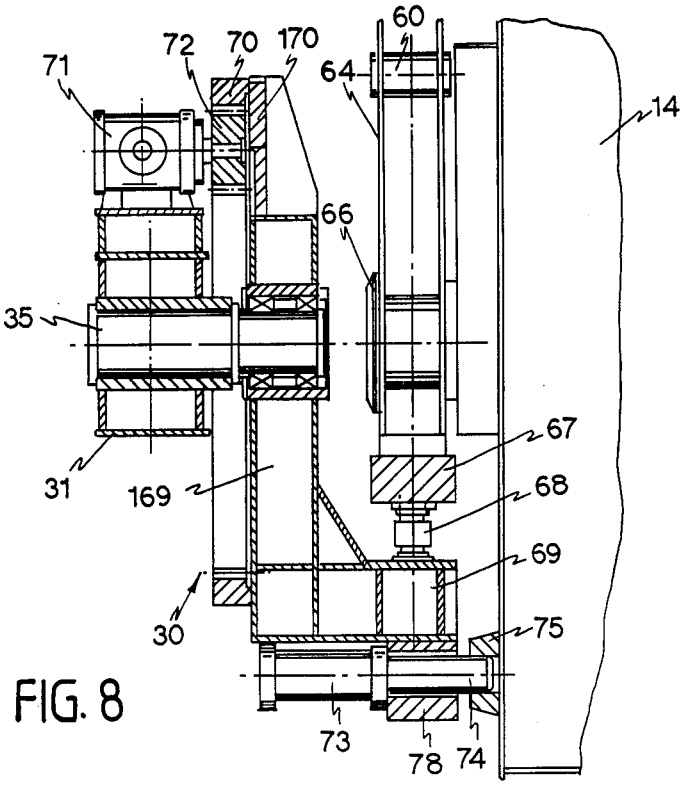
FIG. 8 shows a vertical section of the ladle support zone of the variant of FIG. 7.
Figure 9:
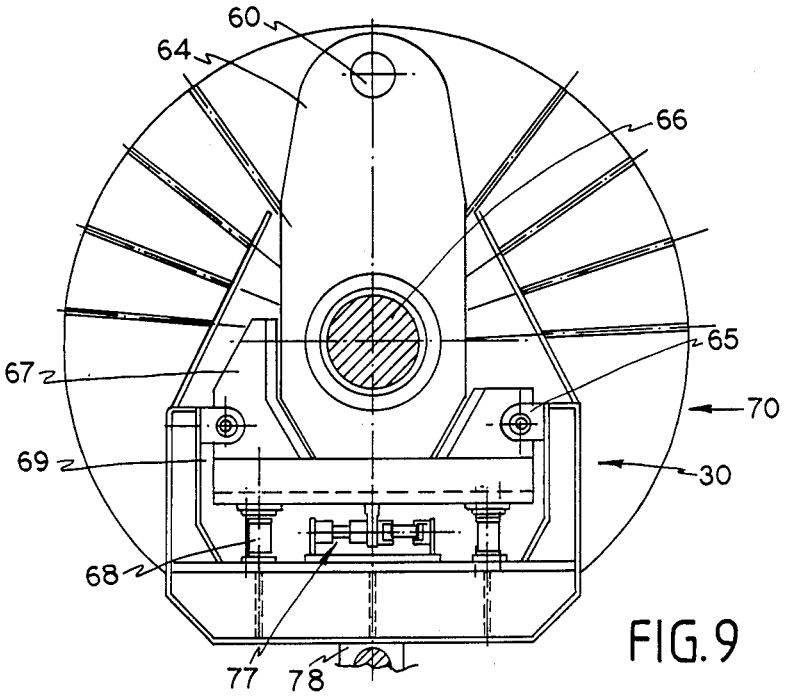
FIG. 9 shows an internal section of the device that rotates the ladle.

In a variation shown in FIGS. 7 to 9 the ladle-rotation means 30 is supported only by the work arm 31. In these figures the references used in the other figures are employed since the parts in question are equivalents.

In the variation the cradle 69, which may comprise the saddle 67 with the load cells 68 for weighing a ladle, is solidly fixed to the toothed ring 70 through the connecting body 169 and carrying body 170.

In this variant the toothed ring 70 covers 360° and therefore enables the ladle to be rotated by more than a full revolution.

The socket 78 of the bolt 74 is located directly on the cradle 69.

In the variant and also in other cases, stabilisers 77 may be provided between the cradle 69 and saddle 67 and will cooperate with the guides 65.

In the variant with only the work arm 31 and without the parallelogram arm 32 the positioning of the ladle 14 may be obtained by hand, or by position monitors located in cooperation with the support pivot 35, or by the motor of the motor reduction unit 71. Position monitors may also be provided which cooperate also with the rotation pivot 34.

Figure 5:
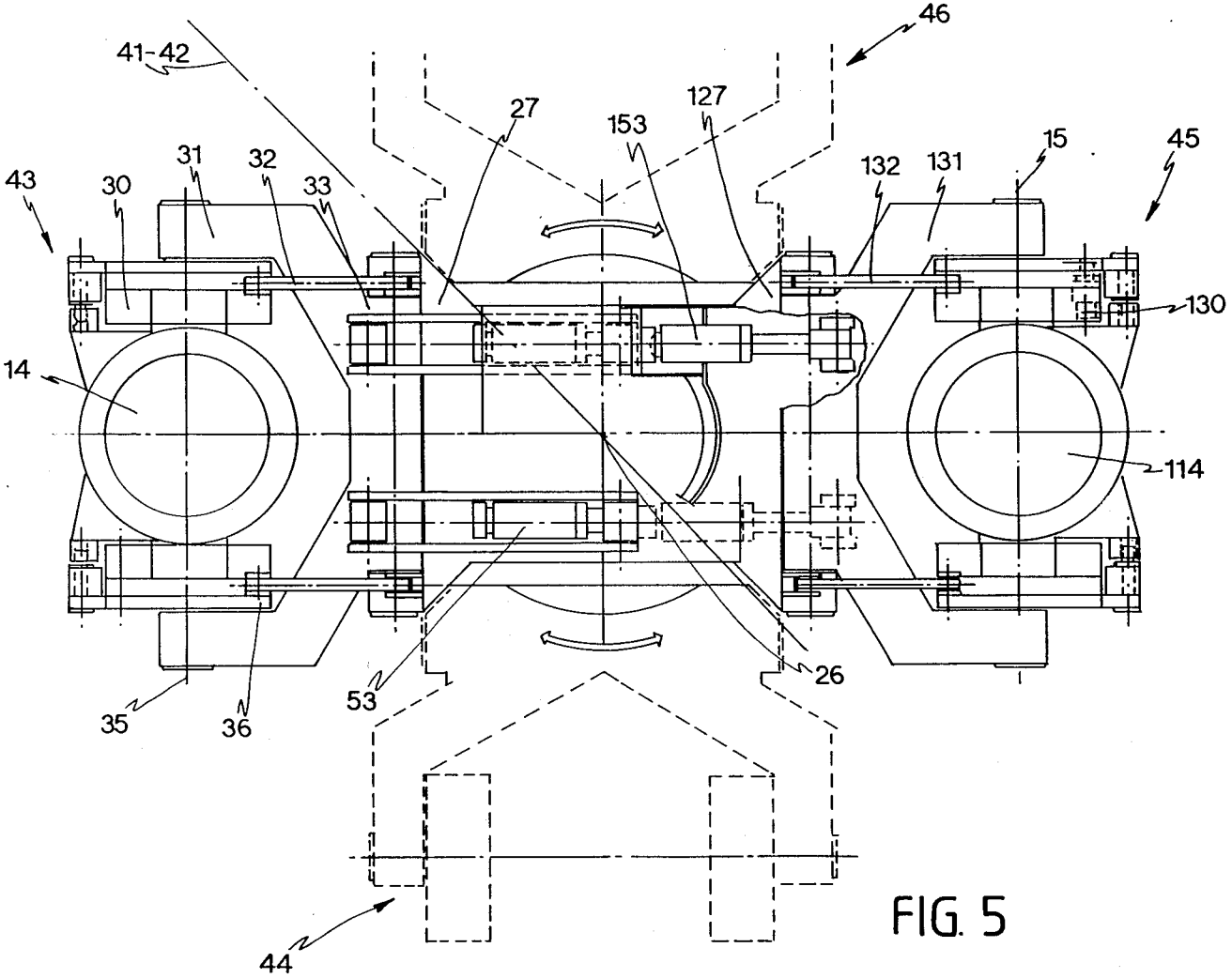
FIG. 5 shows the device of FIG. 1 from above.

The stations shown as examples are five in number, four of them being positioned at about 90° from each other about the vertical axis 26, while one is positioned between two of the four (FIG. 5).

Fewer stations may be provided but will then have multiple functions. Stations in greater number may also be provided and may be positioned at different angles from each other about the vertical axis.

As an example, station 43 for tapping the smelting furnace 11 is located at 180° in relation to a casting station 45 but could also be located at a different angle, and the other stations too could be positioned otherwise than as shown in the figures.

The stations shown as examples are:

41 - station to heat the ladle
42 - station to repair the valve closure of the ladle
43 - tapping station
44 - station for heating the molten bath and for possible degassing
45 - casting station
46 - station to discharge slag and wash ladle.

In the figures the stations 41 and 42 are shown together but can be separated.

In FIG. 5 the stations may also be positioned at about 72° in relation to each other, and the stations 43 and 45 may be positioned at 180° to each other while the stations 46 and 41–42 are positioned at 30° to each other, and so forth.

Such reciprocal positions, in any event, will depend on specific operational requirements and will be selected during design work.

Figure 1:
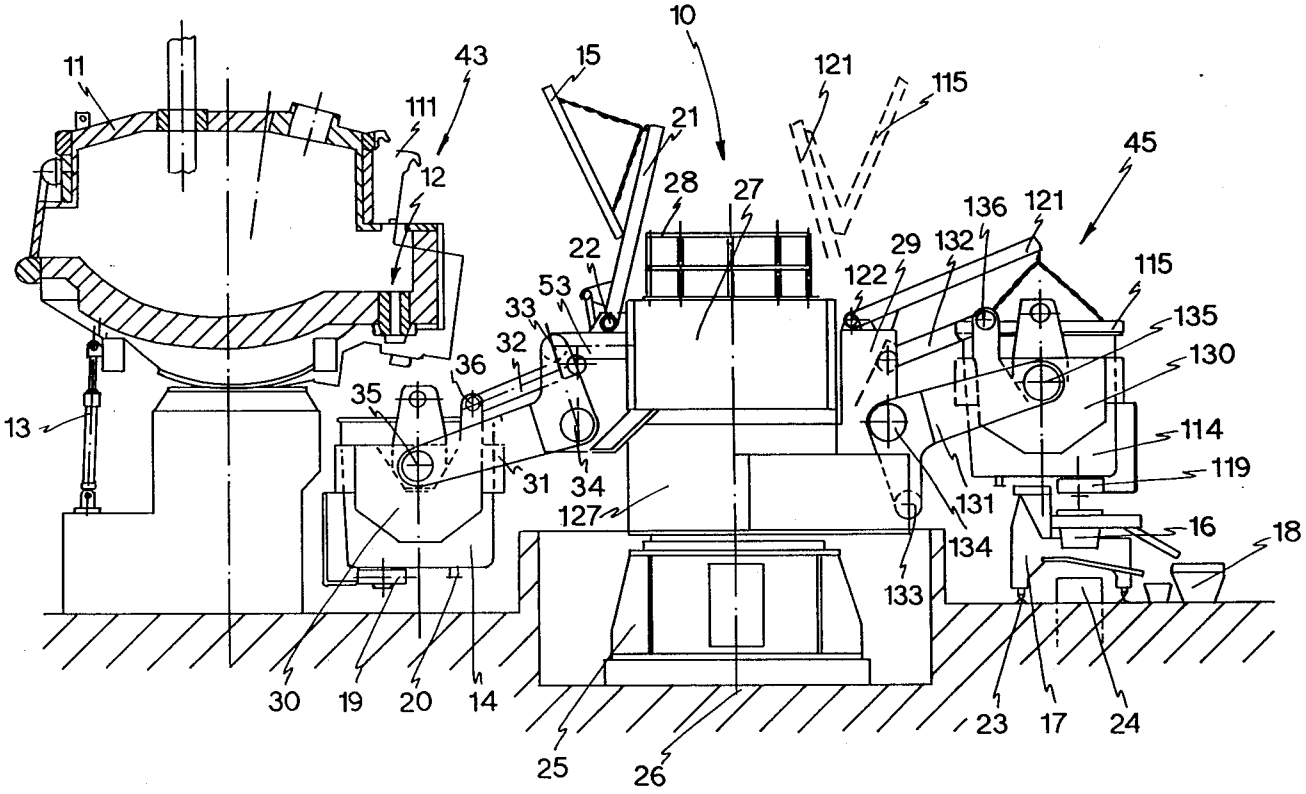
FIG. 1 gives a side view of a device according to the invention and shows the tapping and casting stations.
Figure 2:
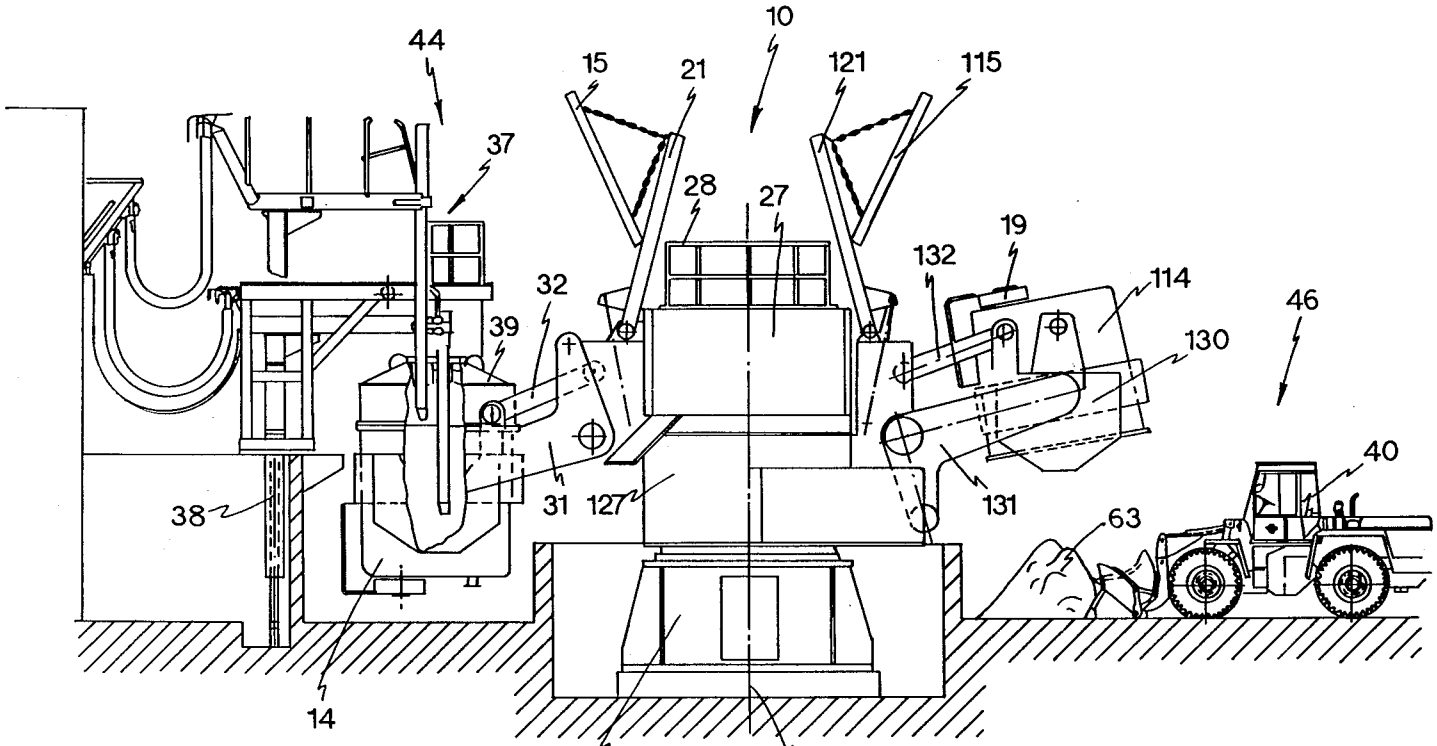
FIG. 2 gives a side view of the device of FIG. 1 at the stations for heating the bath and discharging slag.
Figure 3:
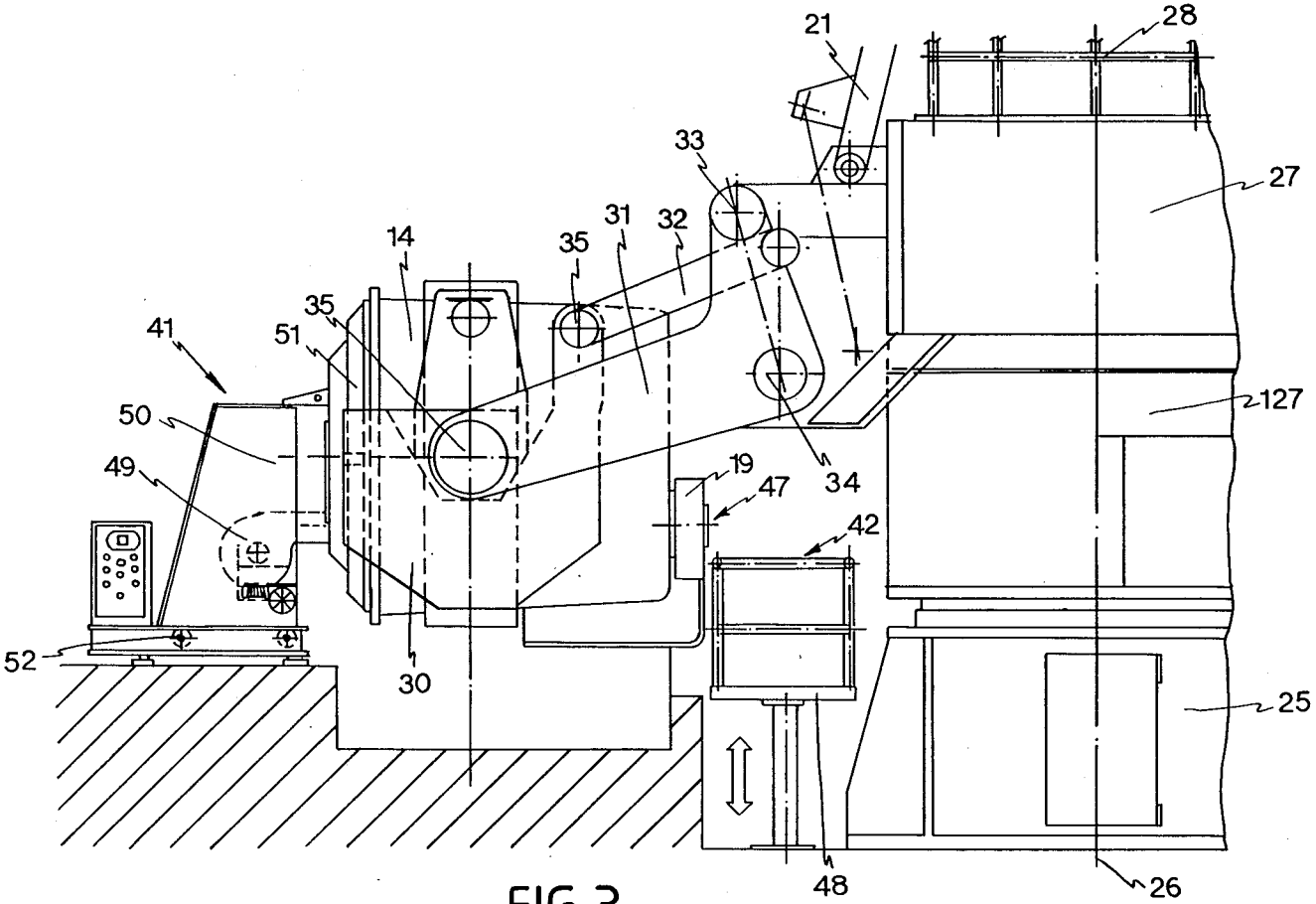
FIG. 3 gives a side view of the device of FIG. 1 in the stations for heating the ladle and repairing the valve-type closure of the same.

In the example of FIG. 1 the station 43 provides the ladle 14 in a low position with the cover 15 raised, since the ladle is ready to cooperate with a sprue 12 of the smelting furnace 11, which can be brought to a tapping position 111 by a jack 13.

The station 44 provides for the ladle 14 to be closed by an domed cover 39 and for the bath of molten metal to be heated by a group of heating electrodes 37 which can be raised vertically by a jack 38.

Besides the heating of the bath of molten metal, the station 44 can also perform the degassing of the bath and the possible addition of corrective chemicals.

The steps of degassing and/or addition of corrective chemicals can be performed at an independent station separate from that where the bath of molten metal is heated.

The casting station 45 is shown as being applied to continuous casting 24 but can be applied to casting into ingot moulds or forms or to mixed casting.

In the embodiment shown the ladle 114 cooperates with a tundish 16 fitted to a trolley 17 which runs on rails 23. The trolley 17 may cooperate either with a usage means 24 or with overflow channels 18.

In the station 45 the ladle 114 is lifted by the work arm 131 above the tundish 16 and is closed with a cover 115.

In the station 46 performing discharge of slag and washing of the ladle 114, the ladle itself is substantially overturned by 180° at least momentarily for the required operations. The slag 63 is removed, for example, with the help of a power shovel 40. The ladle 114 is replaced, if necessary, in this station, but may also be replaced in any of the other stations.

In stations 41 and 42 the ladle 14 has its axis substantially horizontal but may have its axis vertical in one and/or another of the stations.

The station 41 provides for the empty ladle 14 to be closed with an appropriate cover 51, which forms part of a heating trolley 50 able to run on guides 52 and supporting a burner 49. Such burner serves to heat the ladle so as to prepare it to accommodate the molten metal to be tapped in station 43.

The station 42 provides for the help of a movable platform 48 to enable the machine operator to have easy access to the closure 47 of the valve 19, to inspect it and, if necessary, to repair it.

I claim:

1. An apparatus for handling ladles in a metal casting operation, comprising:

a base;

a plurality of coaxial rotary arms, each being independently capable of rotation through 360° in a horizontal plane, each of said rotary arms comprising:

a carrying structure rotatably supported by the base;

a vertically movable work arm extending from the carrying structure and having a free end;

ladle rotation means at the free end of the work arm for supporting and positioning a ladle, the ladle rotation means comprising:

a cradle for supporting and positioning a ladle and an internally-toothed ring for rotating a ladle, the internally-toothed ring and the cradle being part of a unitary body which further comprises means for releasably securing the unitary body to a ladle.

2. The apparatus of claim 1, wherein the means for releasably securing comprises a reciprocating pin for cooperation with a socket on a ladle.

3. The apparatus of claim 1, wherein the ladle rotation means comprises a saddle and at least one load cell for weighing a ladle.

4. The apparatus of claim 1, further comprising a support arm cooperating with the work arm for keeping a ladle in a stable position.

5. The apparatus of claim 1, further comprising a support arm having first and second ends, for keeping a ladle in a stable position, the first end of the support arm cooperating with the work arm, the second end of the support arm cooperating with the ladle rotation means to position the cradle.

6. The apparatus of claim 1, wherein the internally-toothed ring extends for 360°.

7. The apparatus of claim 1, wherein the ladle-rotation means further comprises a toothed wheel cooperating with the internally-toothed ring, and a motor secured to the work arm for driving said toothed wheel.

8. An apparatus for handling ladles in a metal casting operation, comprising:

a base;

a plurality of coaxial rotary arms, each being independently capable of rotation through 360° in a horizontal plane, each of said rotary arms comprising:
a carrying structure rotatably supported by the base;
a vertically movable work arm extending from the carrying structure and having a free end;
ladle rotation means at the free end of the work arm for supporting and positioning a ladle, the ladle rotation means comprising:
a cradle for supporting and positioning a ladle and an internally-toothed ring for rotating a ladle;
a first pivot,
a support body for said internally-toothed ring, rotatably supported on said first pivot, said cradle being rotatably supported on the first pivot independently of the support body; and
means for releasably securing the support body to a ladle.

9. The apparatus of claim 8, wherein the means for releasably securing comprises a reciprocating pin carried by said support body for cooperation with a socket on a ladle.

10. The apparatus of claim 8, wherein the ladle rotation means comprises a saddle and at least one load cell for weighing a ladle.

11. The apparatus of claim 8, further comprising a support arm cooperating with the work arm for keeping a ladle in a stable position.

12. The apparatus of claim 8, further comprising a support arm having first and second ends, for keeping a ladle in a stable position, the first end of the support arm cooperating with the work arm, the second end of the support arm cooperating with the ladle rotation means to position the cradle.

13. The apparatus of claim 8, wherein the ladle-rotation means further comprises a toothed wheel cooperating with the internally-toothed ring, and a motor secured to the work arm for driving said toothed wheel.

14. The apparatus of claim 8, wherein the internally-toothed ring extends for less than 360°.

15. The apparatus of claim 8, wherein the cradle comprises a second pivot to allow rotation of a ladle, said first and second pivots being substantially coaxial.

16. A casting system, comprising:
a furnace for melting metal;
a tapping station for transferring molten metal from the furnace to a ladle;
a casting station for casting molten metal from a ladle; and
an apparatus for handling ladles in cooperation with the tapping station and the casting station and carrying ladles between the tapping station and the casting station, the apparatus comprising:
a base;
a plurality of coaxial rotary arms, each being independently capable of rotation through 360° in a horizontal plane, each of said rotary arms comprising:
a carrying structure rotatably supported by the base;
a vertically movable work arm extending from the carrying structure and having a free end;
ladle rotation means at the free end of the work arm for supporting and positioning a ladle, the ladle rotation means comprising:
a cradle for supporting and positioning a ladle and an internally-toothed ring for rotating a ladle;
a first pivot,
a support body for said internally-toothed ring, rotatably supported on said first pivot, said cradle being rotatably supported on the first pivot independently of the support body; and
means for releasably securing the support body to a ladle.

17. The system of claim 16, further comprising a heating station for heating a ladle carried by said apparatus.

18. The system of claim 17, comprising means for orienting a ladle being heated at said heating station so that the ladle is oriented to open substantially horizontally.

19. The system of claim 17, comprising means for orienting a ladle being heated at said heating station so that the ladle is oriented to open substantially vertically.

20. The system of claim 17, further comprising a station for repair of a valve closure of a ladle carried by the apparatus, and means for orienting a ladle in the station for repair so that the ladle is oriented to open substantially horizontally.

21. The system of claim 20, further comprising a station to heat molten metal in a ladle carried by the apparatus.

22. The system of claim 21, further comprising a station for degassing molten metal in a ladle carried by the apparatus.

23. The system of claim 22, further comprising a station for chemical correction of a molten metal in a ladle carried by the apparatus.

24. The system of claim 23, further comprising a station for discharging slag and washing a ladle carried by the apparatus, and means for inverting a ladle in the station for discharging.

25. The system of claim 16, wherein the means for releasably securing comprises a reciprocating pin carried by said support body for cooperating with a socket on a ladle.

26. A casting system, comprising:
a furnace for melting metal;
a tapping station for transferring molten metal from a ladle; and
an apparatus for handling ladles in cooperation with the tapping station and the casting station and carrying ladles between the tapping station and the casting station, the apparatus comprising:
a base;
a plurality of coaxial rotary arms, each being independently capable of rotation through 360° in a horizontal plane, each of said rotary arms comprising:
a carrying structure rotatably supported by the base;
a vertically movable work arm extending from the carrying structure and having a free end;
ladle rotation means at the free end of the work arm for supporting and positioning a ladle, the ladle rotation means comprising:
a cradle for supporting and positioning a ladle and an internally-toothed ring for rotating a ladle, the internally-toothed ring and the cradle being part of a unitary body which further comprises means for releasably securing the unitary body to a ladle.

27. The system of claim 26, wherein the means for releasably securing comprises a reciprocating pin for cooperation with a socket on a ladle.

28. The system of claim 26, further comprising a heating station for heating a ladle carried by said apparatus.

29. The system of claim 28, comprising means for orienting a ladle being heated at said heating station so that the ladle is oriented to open substantially horizontally.

30. The system of claim 28, comprising means for orienting a ladle being heated at said heating station so that the ladle is oriented to open substantially vertically.

31. The system of claim 28, further comprising a station for repair of a valve closure of a ladle carried by the apparatus, and means for orienting a ladle in the station for repair so that the ladle is oriented to open substantially horizontally.

32. The system of claim 31, further comprising a station to heat molten metal in a ladle carried by the apparatus.

33. The system of claim 32, further comprising a station for degassing molten metal in a ladle carried by the apparatus.

34. The system of claim 33, further comprising a station for chemical correction of a molten metal in a ladle carried by the apparatus.

35. The system of claim 34, further comprising a station for discharging slag with washing a ladle carried by the apparatus, and means for inverting a ladle in the station for discharging.

* * * * *